United States Patent [19]

Kato

[11] 4,030,149

[45] June 21, 1977

[54] BED FOR THE INVALID

[75] Inventor: Mikio Kato, Tokyo, Japan

[73] Assignee: Nippon Felt Co., Ltd., Tokyo, Japan

[22] Filed: Mar. 4, 1976

[21] Appl. No.: 663,830

[30] Foreign Application Priority Data

| | | |
|---|---|---|
| Mar. 7, 1975 | Japan | 50-28159 |
| Mar. 29, 1975 | Japan | 50-36584 |
| Apr. 4, 1975 | Japan | 50-41494 |
| June 18, 1975 | Japan | 50-83067[U] |

[52] U.S. Cl. ..... 5/90; 5/91

[51] Int. Cl.[2] ..... A61G 7/02

[58] Field of Search ..... 4/7, 10, 110, 112; 5/90, 91

[56] References Cited

UNITED STATES PATENTS

| | | | |
|---|---|---|---|
| 2,872,689 | 2/1959 | Fournet | 5/90 |
| 3,345,652 | 10/1967 | Hiraga | 5/90 X |
| 3,668,720 | 6/1972 | Wetzler | 5/90 |
| 3,887,951 | 6/1975 | Yates et al. | 5/90 |

*Primary Examiner*—Casmir A. Nunberg
*Attorney, Agent, or Firm*—Whittemore, Hulbert & Belknap

[57] ABSTRACT

A bed, particularly of the type convenient for the use of an invalid or sick person and specifically constructed to allow the user to defecate while lying on his back on the bed, whereby when the user wants to defecate, a part of the bed mat supporting the buttocks of the user can be removed to form a defecating hole below which an excrement receptacle specifically designed for such use is placed. The bed also comprises a first and a second auxiliary mat adapted to close said defecating hole, a first auxiliary mat support plate lifting means disposed movable longitudinally of the bed below the housing portion of said first auxiliary mat adapted to close the excrement receptacle disposed portion of said defecating hole, a second auxiliary mat support plate disposed beneath the housing portion of the second auxiliary mat adapted to close the leg side portion of said defecating hole, said second auxiliary mat support plate being movable vertically pivoted at a suitable leg side part of said defecating hole, a truck on which is removably rested an excrement receptacle having an openable front covering which can be set at any desired angle conforming to the body structure of the user within the range of the maximum inclination, said truck being disposed beneath said second auxiliary mat support plate and supported so as to be movable synchronously with the first auxiliary mat lifting means, said truck and second auxiliary mat support plate being articularly joined by bars or other like means such that said second auxiliary mat support plate will take a horizontal position when said truck is located at a position just beneath the buttocks of the user or at a position remotest from the user's buttocks, and that said second auxiliary mat support plate will take an upwardly moved position when said truck stays at an intermediate position, said front covering of said excrement receptacle being connected to a suitable part of the second auxiliary mat support plate by a string or like means through the medium of an elastic body so that said front covering will be opened up in accordance with turning motion of said second auxiliary mat support plate caused by parallel movement of said truck from the retracted non-use position to the position of use immediately below the user's buttocks.

8 Claims, 23 Drawing Figures

BED FOR THE INVALID

BRIEF SUMMARY OF THE INVENTION

This present invention relates to an invalid bed which has formed centrally thereof a rectangular defecating hole elongated longitudinally of the bed and normally closed by a first and a second auxiliary mat, and which comprises, among other elements, a first auxiliary mat support plate lifting means comprising X-shaped expansion arms movable longitudinally of the bed, said lifting means being disposed beneath the housing portion of said first auxiliary mat normally covering the excrement receptacle disposed portion of said defecating hole and adapted to horizontally support the first auxiliary mat support plate so that it is movable vertically, a second auxiliary mat support plate arranged swingable vertically about a pivot provided at an edge of said defecating hole, said second auxiliary mat support plate being disposed below the housing portion of said second auxiliary mat normally closing the leg side portion of said defecating hole, and a truck removably carrying thereon an excrement receptacle having an openable front covering which can be set to a desired angle suiting the body structure of the user within the range of the maximum allowable inclination, said truck being disposed beneath said first and second support plates and arranged movable in the direction of movement of said first mat support plate lifting means, said truck and said second auxiliary mat support plate being articularly joined by bars or other like means such that the angle of inclination made with the passage of said truck will become smallest when said truck is at the foremost or rearmost position, said front covering of said excrement receptacle being also connected to a suitable position on said second auxiliary mat support plate by a leather band through the medium of an elastic body, said truck being also coupled to said X-shaped or crossed expansion arms by horizontal connecting bars so that, in the forward stroke of said truck, said X-shaped expansion arms will expand out to lower the second auxiliary mat support plate and push it out forwardly of the bed, and in the return stroke, said expansion arms will be pulled back to their original contracted position to raise up the second auxiliary mat support plate to its original upward position. Thus, in the bed of this present invention, the first and second auxiliary mats which normally stay at the horizontal position are moved in accordance with back and forth movement of the excrement receptacle truck beneath the defecating hole, that is, the first auxiliary mat moves both vertically and laterally and the second auxiliary mat moves vertically with movement of said truck, while the excrement receptacle on said truck, with its front covering reaised up, advances toward the crotch of the invalid and attaches closely to his skin. During use of the receptacle, the second auxiliary mat stays at the position where it closes the unnecessary part of the defecating hole in the bed. According to another feature of this present invention, the first auxiliary mat designed to normally support the buttocks of the invalid lying thereon can move vertically and horizontally successively in accordance with back and forth movement of the truck, with said horizontal movement being made in the same direction as movement of the truck through the media of connecting bars and auxiliary connecting bars, so that the structure of this invention can be adapted not only to the relatively tall beds such as beds for Western-style rooms or hospital beds, but also to the beds designed for use in Japanese-style rooms if the bed has a height sufficient to allow back and forth movement of the excrement receptacle below the bed. This arrangement can also markedly simplify the exchange mechanism for said auxiliary mats and excrement receptacle as compared with the conventional beds of this type.

Further, according to the bed of the present invention, since the front covering of the excrement receptacle is opened and closed with movement of the truck which moves in abedience to said first auxiliary mat, the associating mechanisms in the bed structure are perfectly free of idleness and can operate correctly, and moreover, said front covering, when not used, is folded down to serve as a cover for the excrement receptacle to avoid unpleasantness in handling of the receptacle after use. Still further, when the receptacle is fixed in its position of use, said front covering, which is attached to the user's crotch, never rubs his skin strongly, thus solving such problem of the conventional invalid beds where the excrement receptacle is mounted vertically movable.

BRIEF DESCRIPTION OF THE DRAWINGS

FIGS. 18 to 22 are drawings showing a modified form of front covering in accordance with the present invention, wherein FIG. 18 is a side view, FIG. 19 is a bottom view, FIG. 20 is a sectional view taken along the line XX—XX of FIG. 18, FIG. 21 is a side view showing a mode of use of said front covering, and FIG. 22 is a side view also showing a mode of use when an auxiliary block was drawn out.

DETAILED DESCRIPTION OF THE INVENTION

Now the present invention is described in detail by way of some preferred embodiments thereof in conjunction with the accompanying drawings.

Figure 1:
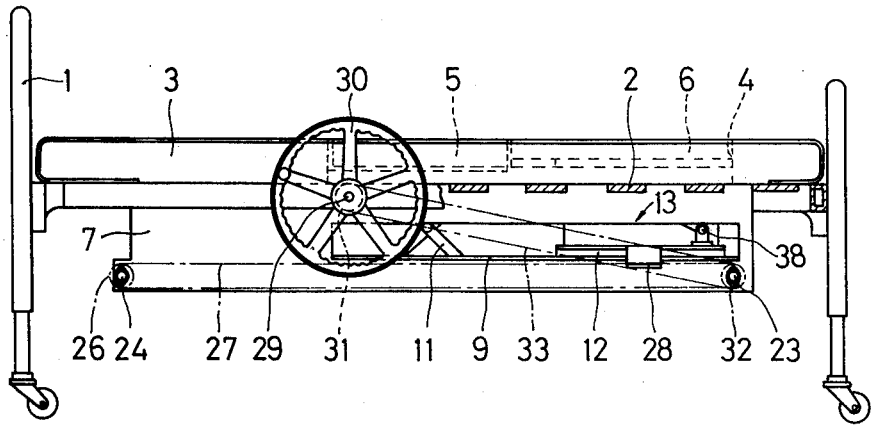
FIG. 1 is a general side elevational view of a bed in accordance with the present invention, said bed being shown in a normal state where the excrement receptacle is in its non-use position.

Referring first to FIG. 1, there is shown a general side elevational view of an invalid bed in accordance with the present invention comprising essentially a bed frame 1, floor planks 2 and a main mat 3 laid on said floor planks. The main mat has a rectangular defecating hole 4 formed longitudinally of the bed in the center of the mat portion where the lower half of the user's body rests. This defecating hole is normally closed by a first auxiliary mat 5 and a second auxiliary mat 6. Below said defecating hole 4 is provided a rectangular box-like auxiliary frame 7 assembled in dimentional accord with the width and length of said defecating hole, said frame 7 being secured horizontally to said bed frame 1 in suspension therefrom. Laid at symmetrical positions in said auxiliary frame 7 are the rails 8, 8 and rails 9, 9 which are at different levels from each other. Movably supported on said rails 8, 8 laid at the lower level is an auxiliary mat support plate lifting means 70 comprising a pair of crossed or X-shaped expansion arms 11, 11 which support a plate 10 on which said first auxiliary mat 5 rests. Movably carried on the rails 9, 9 at the higher lever is a truck 12 which is so designed that an excreta receptacle 13 can be removably fitted thereinto slidingly from its top opening.

Said excreta receptacle 13 is formed from a box-like excreta tank 19 having at its top a seat 20 formed with a U-shaped hole 21. Also secured openably to said excreta receptable 13 is a front covering structure 22 which can function as the cover for said receptable 13 and is so designed that it can be set to any desired angle to suit the body build of the invalid within the range of the maximum inclination. Said front covering structure 22 consists of a proximal block 71 and a distal block 72 pivotally joined to each other, said both blocks being angular in sectional shape. This front covering structure 22 is so arranged that it will just fit with and cover up the hole 21 in said seat 20 when the excreta receptable 13 is not used. It is desirable that said receptacle 13, in use, is set at a level where when it is placed just below the user's buttocks, the seat 20 will be located in closest possible proximity to the user's buttocks without touching them or only slightly touching them.

Figure 15:
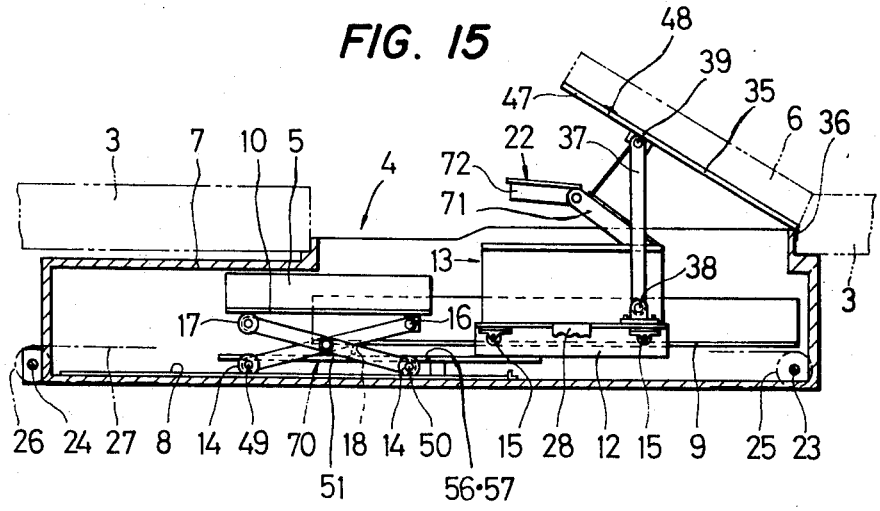
FIG. 15 is a similar view to FIG. 14 but showing the corelationship between the front covering of the excrement receptacle and the first and second auxiliary mat support plates when the receptacle truck has been moved until the connecting bars assumed the upright position.
Figure 16:
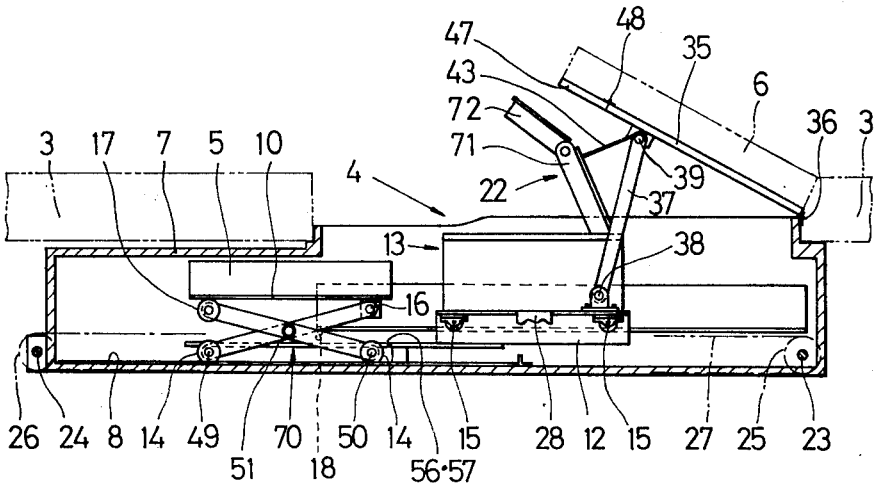
FIG. 16 is also a similar view but showing the corelationship between the truck and the first and second auxiliary mat support plates when the front covering of the excrement receptacle has been opened up to the maximum inclination.
Figure 17:
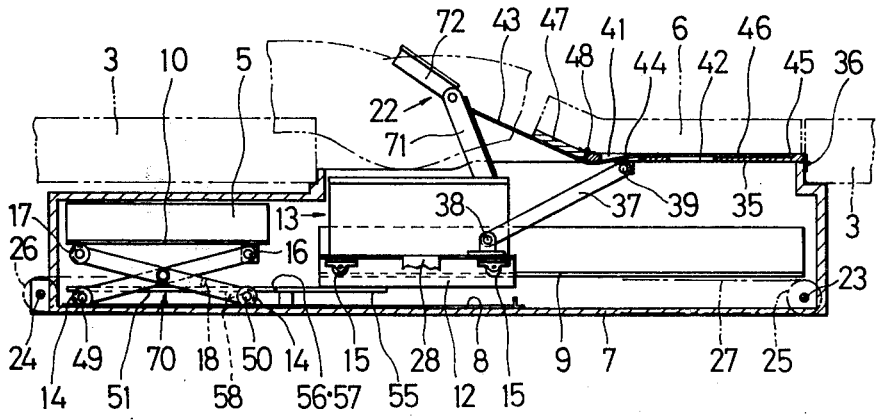
FIG. 17 is also a similar view but showing the positional relation between the excrement receptacle truck and the first and second auxiliary mat support plates when the receptacle was set to its position of use.
Figure 18:
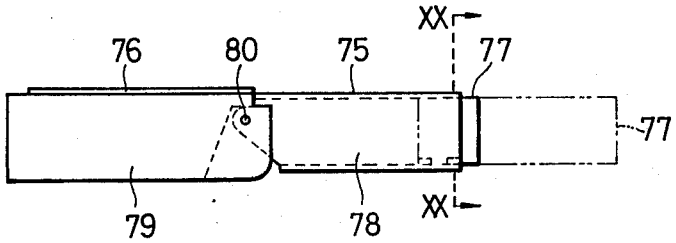
Figure 19:
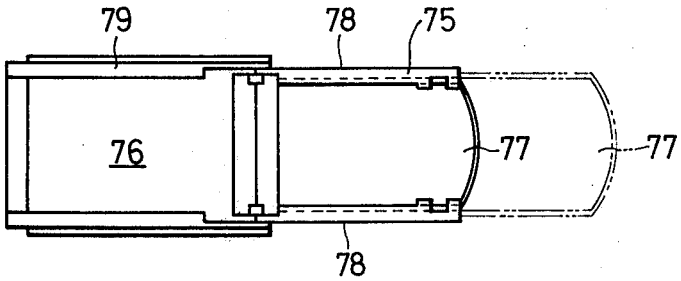
Figure 20:
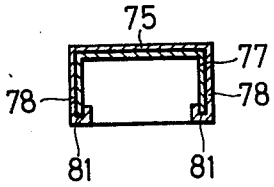
Figure 21:
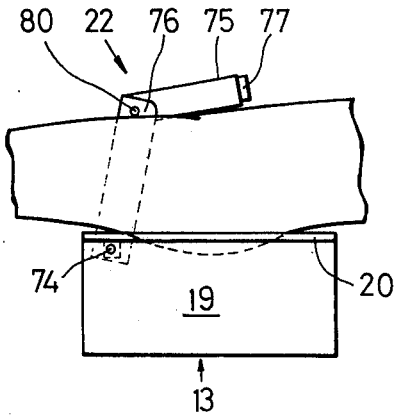
Figure 22:
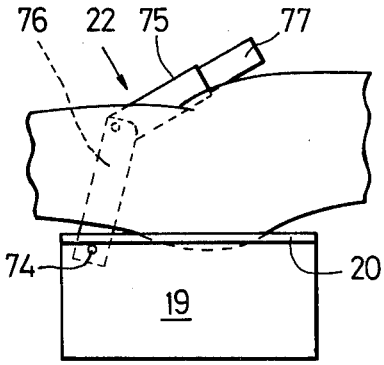

In an embodiment of the invention, said front covering structure 22 is so constructed that it may be bent at its middle point as shown in FIGS. 15 to 17, but it may also be constructed as shown in FIGS. 18 to 22. The covering structure 22 is slidably supported to the seat 20 by a shaft 74 passed through a leg side end of the excreta tank 19. This structure 22 consists of a distal block 75 and a proximal block 76, said distal block 75 having an auxiliary block 77 which is slidable therein to extend out from said structure 22.

Numeral 78 indicates side panels disposed on both sides of said distal block 75, and numeral 79 indicates side panels provided on both sides of said proximal block 76. Said both side panels 78 and 79 are joined by a pin 80 so that said both distal and proximal blocks 75 and 76 may be bent either forwardly or backwardly. Along the lower edges of said side panels 78, 78 of the distal block 75 are also formed guide channels 81 along which said auxiliary block 77 can slide.

The auxiliary mat support plate lifting means 70 comprises a pair of symmetrically arranged K-shaped expansion arm assemblies 11, 11 which are connected at their lower ends by supporting shafts 49, 50 each of which carries at its ends the freely rotatable wheels 14, 14. The upper end of one arm of each said X-shaped expansion arm assembly, 11 is pivoted by a pin 16 to a bottom fixture of the auxiliary mat support plate 10, while the upper end of the other expansion arm carries a wheel 17 arranged to support said plate 10. The corresponding lower arm portions of said pair of X-shaped expansion arm assemblies are connected by stopper bars 18 adapted to regulate the maximum degree of expansion of said crossed expansion arms.

The truck 12 has in its center a recession for accommodating the excreta receptacle 13 and carries near its four corners the wheels 15, 15, 15, 15, with a support plate 28 being secured to a middle part of the truck. A pair of endless chains 27 are passed round respective sprockets 25, 26 secured to a drive shaft 23 arranged to be rotatable in either direction manually or electrically (provided at the extreme right end of the auxiliary frame 7 in FIG. 2) and a follower shaft 24 (provided at the extreme left end of said frome in said figure), and said pair of chains 27 are partly fixed to said support plate 28 so that the truck 12 will move either rightwards or leftwards in FIG. 1 in accordance with rotation of said drive shaft 23.

Numeral 29 indicates a small pivotal shaft projecting laterally from a central side of the bed frame 1 for allowing manual operation of said drive shaft 23. At an end of said shaft 29 is mounted a large-diameter hand wheel 30 so that the invalid, while lying on the bed, can turn said hand wheel 30 with his hand. An endless chain 33 is passed round sprockets 31 and 32 secured to the drive shaft 23 and small shaft 29, respectively, to thereby operatively connect said hand wheel shaft 29 and drive shaft 23. In case of operating the drive shaft 23 by electrical means, a clutch 34 is provided on the small shaft 29 intermediate said hand wheel 30 and sprocket 31 to inhibit rotation of the hand wheel 30 by other than electrical means.

A second auxiliary mat support plate 35 is hinged at 36 to the box-shaped auxiliary frame 7 located beneath the second auxiliary mat 6. This second auxiliary mat support plate 35 is adapted such that when the excreta receptacle 13 carried on the truck 12 is moved to the position close to the user's toes non-use position, said plate 35 will close the leg side portion of the defecating hole 4 while leaving only the top portion of the receptacle 13. Normally, said plate 35 is secured in the position flush with the floor planks 2. This second auxiliary mat support plate 35 can be also swung up and down by a pair of arms 37 pivotally secured by pins 38 to both sides of the truck 12. The upper ends of said pair of arms 37 are connected by a rod 39 which is removably fitted in a pair of U-shaped leaf springs 40 secured to the underside of said second auxiliary mat support plate 35. When said rod 39 is pulled out of said leaf spring 40, the second auxiliary mat support plate 35 can be freely opened up, but normally said support plate 35 which is hinged to the rearmost part of the auxiliary frame 7 is swung up and down in accordance with movement of said arms 37. That is, said support plate 35 maintains the horizontal position along with the auxiliary mat 6 only when the truck 12 stays at the position close to the user's toes, that is, when the excreta receptacle 13 is at its non-use position, or when the truck 12 stays at the position below the user's buttocks, that is, when the excreta receptacle 13 is brought to the position of use, with the excreta tank 19 being positioned immediately beneath the user's buttocks and with the front covering 22 being located in touch with the user's crotch.

In the center of said second auxiliary mat support plate 35 are formed holes 41 and 42 in juxtaposition, and a leather band 43 is detachably fastened to a central portion of the front covering 22 of the excreta receptacle 13. Said hole 41 is provided for the purpose of facilitating attachment and detachment of the leaf springs 40 to the rod 39 which pivotally connect said arms 37, while said hole 42 is designed for facilitating attachment and detachment of the leather band 43 to the front covering 22. Said leather band 43 is extended out from below the rod 39 and through the hole 41, and a highly elastic and stout rubber band 44 is joined to an end of said band 43, said rubber band 44 being also connected detachably and adjustably in expansion to a hook 45 provided at the hinged side portion 36 of said second auxiliary mat support plate 35. In this way, the front covering 22 is connected to said second auxiliary mat support plate 35. There is also provided a slot 46 for placing said rubber band 44 below the plane of said second auxiliary mat support plate 35. A flap 47 is joined by hinges 48 to an end of said second auxiliary mat support plate 35 so that said end flap 47 alone can be freely bent upwardly.

Figure 23:
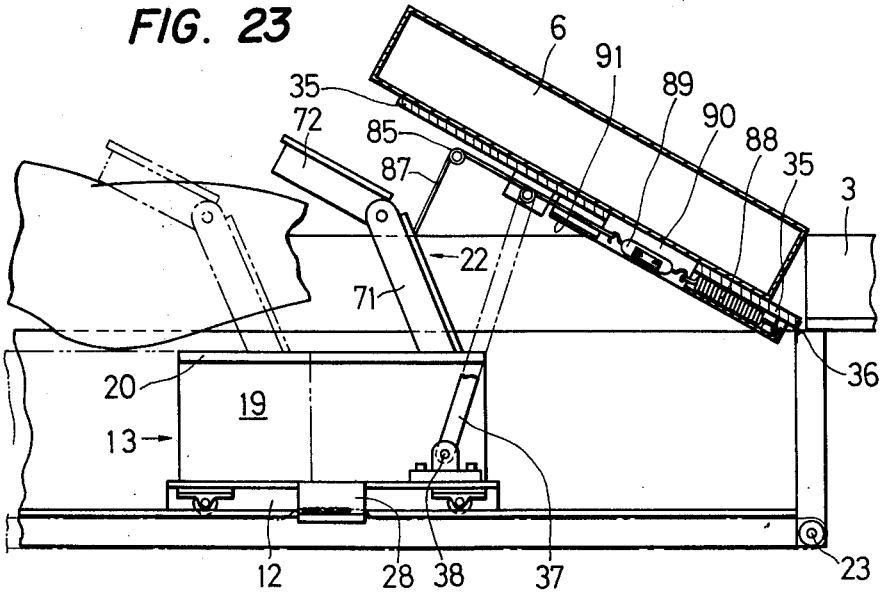
FIG. 23 is a longitudinal sectional view showing a modified form of the second auxiliary mat support plate.

FIG. 23 shows an embodiment where a coil spring is used as the elastic element. A guide roller 85 is provided parallel to the underside of the free end side portion of the second auxiliary mat support plate 35. Passed round said guide roller 85 is a string 87 having no elasticity, such as chain, strap, tape or band, which has its one connected to a pertinent part of the front covering 22 so that such string can be easily detached, if so desired, by using a hook or other suitable means. The other end of said string is joined to an end of a coil spring 88 whose other end is secured to the underside of the hinged end of the second auxiliary mat support plate 35, and a fastening means such as a turnbuckle 89 is provided between said string 87 and coil spring 88 to allow adjustment of the pulling force of said coil spring 88. 90 is an elongated slot provided in said auxiliary mat support plate 35 for facilitating the adjusting work of said turnbuckle 89, and 91 is a cover or casing adapted to conceal said coil spring 88, turnbuckle 89 and a part of string 87 from the underside thereof.

The first auxiliary mat support plate lifting means 70 and the truck 12 are connected by a connecting bar 52. Connecting bars 51, 52 are provided in parallel relation on the supporting shafts 49, 50 of said first auxiliary mat support plate lifting means 70, and a holding member 53 is provided at the end of said bar 51 on said supporting shaft 49 for loosely holding said shaft 49. An end of the connecting bar 52 is secured by the supporting shaft 49 by a pipe holder 54 so that said bar 52 is rotatable but unmovable horizontally.

Figure 8:
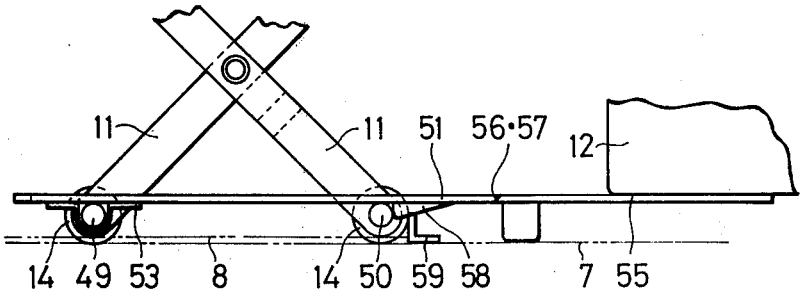
FIG. 8 is a side view showing the relation between auxiliary connecting bars and two connecting bars when the excrement receptacle truck is at its original position.
Figure 12:
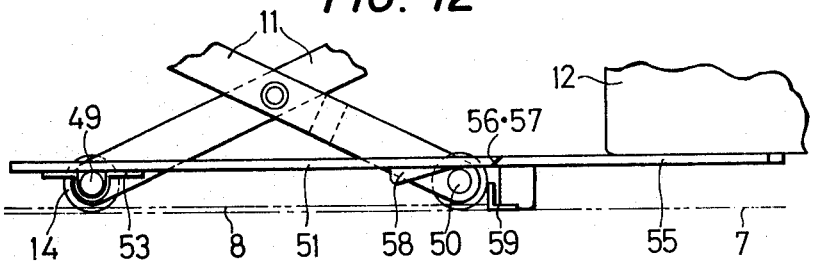
FIG. 12 is a side view showing the relation between said connecting bars at the moment when the X-shaped expansion arms were released.
Figure 13:
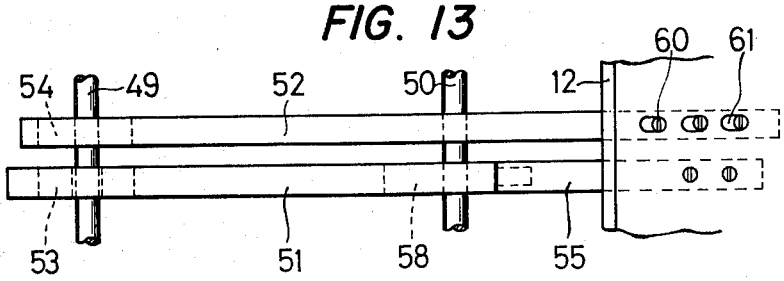
FIG. 13 is a top plan view thereof.

55 is an auxiliary connecting bar secured to the underside of the truck 12 so that said bar 55 is flush and in axial alignment with the connecting bar 51. At the opposing ends of said both connecting bars 55 and 51 are formed bevels 56 and 57, respectively, which are so formed that they make well-fitted plane contact with each other without compromising the above-said relation. Thus, when the auxiliary connecting bar 55 is moved to the left in FIG. 10, its bevel 56 fits with and forces up the corresponding bevel 57 of the bar 51 to raise up the right end (in FIGS. 10 and 12) of said bar 51. 58 is a right-angled triangular cam adapted to engage with the supporting shaft 50 when both connecting bars 51 and 55 are linearly joined to each other with their respective bevels 57 and 56 fitting squarely with other as shown in FIG. 8. Said cam 58 is secured to the underside of the connecting bar 51 and rounded at its downfacing corner adjacent to the supporting shaft 50. The positional relation between said supporting shaft 50 and cam 58 is quickly changed after said rounded portion of said cam has contacted with said shaft 50, but said cam 58 maintains its engagement with the shaft 50 to inhibit casual movement of the first auxiliary mat support plate lifting means 70 in the direction of the user's waist (in the left direction in FIG. 10) until the engaging bevels 56 and 57 of said connecting bars shift relative to each other to disengage said connecting bars 51 and 55 from each other as shown in FIG. 12. 59 is stoppers adapted to stop rightward movement of said first auxiliary mat support plate lifting means 70 when said cam 58 has engaged with the supporting shaft 50 in the return stroke of said lifting means 70.

Planted at the other end of said connecting bar 52 are pins 60 which fit in the respective elongated slots 61 formed in the bottom of the truck 12 in a line in the direction of movement thereof. Each of said slots 61 is of a length equivalent to the length of said bevels 56, 57 and designed to inhibit transmission of the one direction movement by a distance equal to the length of each said slot 61.

The above-described embodiment of the present invention operates as follows.

In the normal state, the user of the bed such as an invalid lies on the bed with his buttocks positioned on the first auxiliary mat 5 supported horizontally by its support plate 10 which, in turn, is supported by the X-shaped expansion arms 11, 11 but when he turns the hand wheel 30 counterclockwise in FIG. 1 to let the drive shaft 23 turn also counterclockwise in FIG. 1 through the endless chain 33, the endless chains 27 are urged to move in the same direction, causing the truck 12 to begin moving to the left in the same figure as said truck 12 is joined to said endless chains 27.

Figure 10:
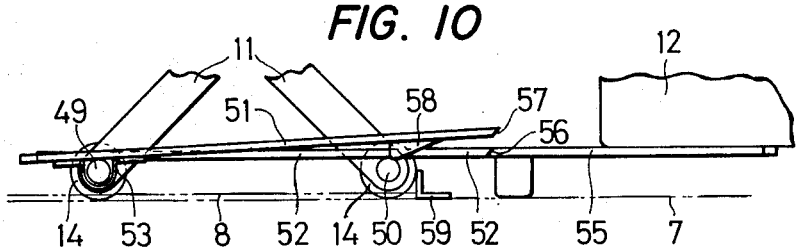
FIG. 10 is a side view showing the relation between said respective connecting bars when the excrement receptacle truck has just moved a slight distance away from the original position.
Figure 11:
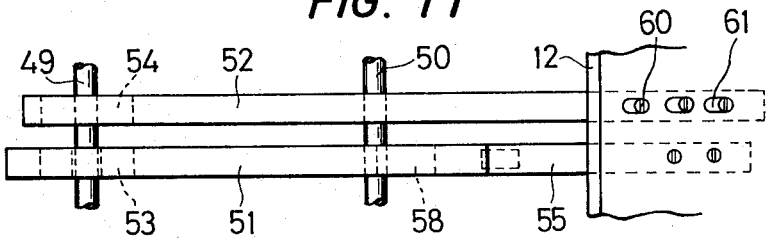
FIG. 11 is a top plan view thereof.

When the truck 12 starts to move, the auxiliary connecting bar 55 secured to the bottom of said truck is forced to move correspondingly, so that the bevel 56 at the end of said bar 55 presses against the engaging bevel 57 of the opposed connecting bar 51 (see FIG. 8) to raise up the beveled end 57 of said bar 51 (see FIG. 10). When the bar 51 is further pressed by the beveled end of the connecting bar 55, the right-angled triangular cam 58 provided to said bar 51 is disengaged from the supporting shaft 50 owing to said rise-up of the beveled end of said bar 51 (see FIG. 12), thus releasing the holding force acting to inhibit the support shafts 49, 50 of said X-shaped expansion arms 11 from spreading out.

Figure 14:
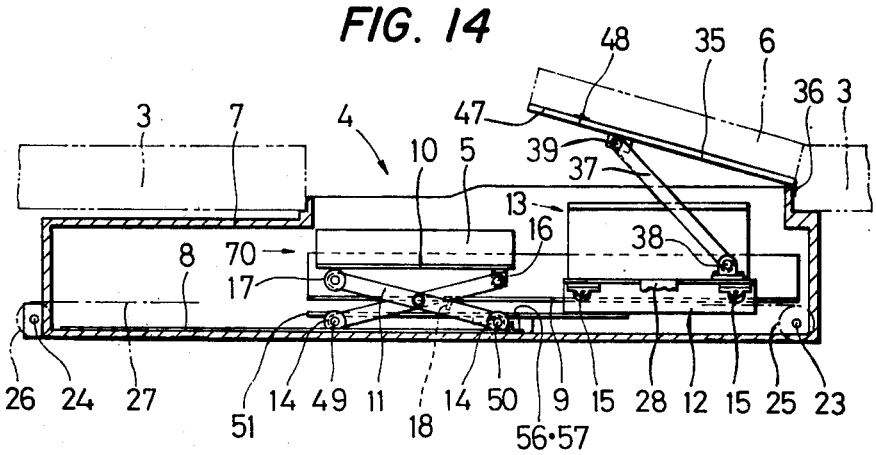
FIG. 14 is a longitudinal sectional side view of the essential parts of the invention showing the corelationship between the excrement receptacle truck and first and second auxiliary mat support plates when the X-shaped expansion arms were spread out.

On the other hand, bar 51 moves in the same direction as said auxiliary connecting bar 55 but slightly delayed after said bar 55 owing to retardation by the elongated slots 61, so that the lower left arms of the respective X-shaped expansion arm assemblies 11, which have been freed from hold as said above, are pushed to the left by the pushing force of said bar 52 as shown in FIG. 14 to let the arms of said X-shaped arm assemblies expand out, whereby the wheels 14 at the ends of the lower left arms are urged to move rolling on the rails 8 while the wheels 17 at the ends of the upper left arms are forced to move rolling in contact with the underside of the support plate 10. Thus, the X-shaped expansion arms 11 expand out to the limit at which the left and right upper arms abut against the stoppers 18, causing the first auxiliary mat 5 resting on said plate 10 to lower down. At the same time, support shaft 49 pushes the stopper 53, which is secured to the bar 51, to the left in FIG. 12 to drag said shaft 51 which has been previously freed, so that the right-angled triangular cam 58 secured to the underside of said bar 51 moves to the left on the supporting shaft 50 to gradually lower down the right end of the bar 51 until said bar 51 restores its horizontal position (see FIG. 14).

As the bar 52 continues to push the supporting shaft 49 of the X-shaped expansion arms 11, 11 with leftward displacement of the continuously moving truck 12, said X-shaped expansion arms 11 move the left while maintaining their expanded state, causing the first auxiliary mat 5 on its support plate 10 to move away gradually from the defecating hole 4 in the main mat 3 as shown in FIG. 15.

When the truck 12 begins to move to the left in the manner described above, the bars 37 connecting said truck 12 and second auxiliary mat support plate 35 urge the pivoted portion 38 on said truck 12 to move horizontally to the left, so that the pivoted portion 39 on said plate 35 is constrained to make a circular motion about the pivoted portion 36 of said plate 35 to let said plate turn upwardly.

As the truck 12 moves further in the same direction, the angle of inclination of the bars 37 relative to the rails 9 is gradually enlarged until they take the upright position. Since the angle of inclination of the auxiliary mat support plate 35 is also enlarged in accordance as said bars 37 approach the upright position, the front covering 22 of the excreta receptacle 13 resting on the truck 12 is raised up by the action of the leather band 42 which is tensioned by said movement, thus opening the U-shaped hole 21 in the defecating seat 20. Under this condition, the rubber band 44 joined to said leather band 43 does not extend out and the front covering 22 is kept pulled by said leather band 43 at least until said covering 22 reaches the maximum inclination mentioned below.

The maximum inclination of the front covering 22 is preset by a cam (not shown) in conformity to the body build of the bed user, so that it won't rise up further than a certain extent. The rubber band 44 begins to stretch out gradually as the truck 12 moves away further from its original position after passage of the bars 37 over the dead point, allowing the front covering 22 to approach the crotch of the user while maintaining its maximum inclination (see FIG. 16). In the meanwhile, inclination of the bars 37 becomes smaller gradually after passage of the dead point, so that inclination of the auxiliary mat support plate 35 is also reduced steadily, and when the excreta receptacle 13 reaches immediately below the user's buttocks with the defecating seat 20 being positioned in close proximity to or in slight touch with the user's buttocks as shown in FIG. 17, the front covering 22 attaches closely to the user's crotch. At this time, if need be, auxiliary block 77 may be drawn out from the distal block 75 as in the embodiment shown in FIGS. 18 to 22. Under this condition, inclination of the bars 37, which are regulated in their positional relation with other parts, becomes smallest to let the auxiliary mat support plate 35 return to its horizontal position, so that the second auxiliary mat 6 resting on said support plate 35 covers up the rear portion of the defecating hole 4 to reduce said hole to a size which just opens into the excreta receptacle 12. The first auxiliary mat 5 is perfectly concealed below the main mat 3.

After defecation, the user turns the hand wheel 30 in the opposite direction to let the drive shaft 23 turn reversely, causing the truck 12 to return to its original position by means of endless chains 27.

When the truck 12 moves to the right in FIG. 17, the pivot 38 on the truck 12 of the bars 37 connecting said truck 12 and second auxiliary mat support plate 35 changes its position in the same direction, allowing said plate 35 to again move upwardly to open the defecating hole 4, while the tension of the leather band 43 or string 87 which pulls the front covering 22 of the excreta receptacle 13 on the truck 12 is weakened to let the rubber band 44 or spring 88 contract accordingly. By the time when the bars 37 have approached their upright position, the first auxiliary mat 5 will have emerged substantially beneath the defecating hole 4 while the rubber band 44 or spring 88 returns gradually to the non-stretched state. The leather band 43 or string 87 also becomes loose to lessen their traction of the front covering 22, allowing the latter to lower down gradually. When the bars 37 pass their upright position and the X-shaped expansion arms 11 supporting the plate 10 move to a point where the first auxiliary mat 5 presents itself perfectly in the defecating hole 4, stoppers 59 on the rails 8 catch the wheels 14 at the ends of the lower right portions of the said expansion arms 11 to inhibit rightward movement of said arms 11 as shown in FIG. 14, but since the truck 12 continues to move to the right, the connecting bar 51 coupled to said truck 12 continues to drag the support shaft 49 secured to the lower left portions of said X-shaped expansion arms 11 to let said arms close gradually while causing the plate 10 carried on said arms to rise up together with the first auxiliary mat 6. On the other hand, connecting bar 51 moves to the right with closing motion of said X-shaped expansion arms 11, and when the right-angled triangular cam 58 provided on the underside of said bar 51 passes over the shaft 50 secured to the lower right portions of said arms 11 positioned by stoppers 59, the opposing bevels 56 and 57 of said bars 55 and 51 engage with each other and thus the truck 12 returns to its original position. When the vertical portion of said cam 58 engages with the shaft 50, said bar 51 is held back by said shaft 50 against any casual movement to the left. In this condition, the X-shaped expansion arms 11 are at their most closed or constricted position and the first auxiliary mat 5 on its support plate 10 perfectly closes the fore portion of the defecating hole 4, or its portion below which the excreta receptacle is placed when in use. The X-shaped expansion arms 11 are maintained in said state by stopper 53 secured to the left end of the bar 51 in FIG. 2.

Figure 9:
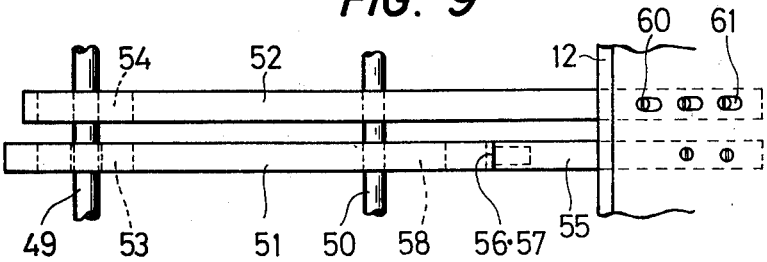
FIG. 9 is a top plan view thereof.

In this way, the first auxiliary mat 5 and truck 12 return to their original positions while the connecting bars 51, 52 and auxiliary connecting bar 55 take the positions shown in FIGS. 8 and 9, and this condition is maintained until the said operation for bringing the excreta receptacle to its position of use is made again.

Figure 2:
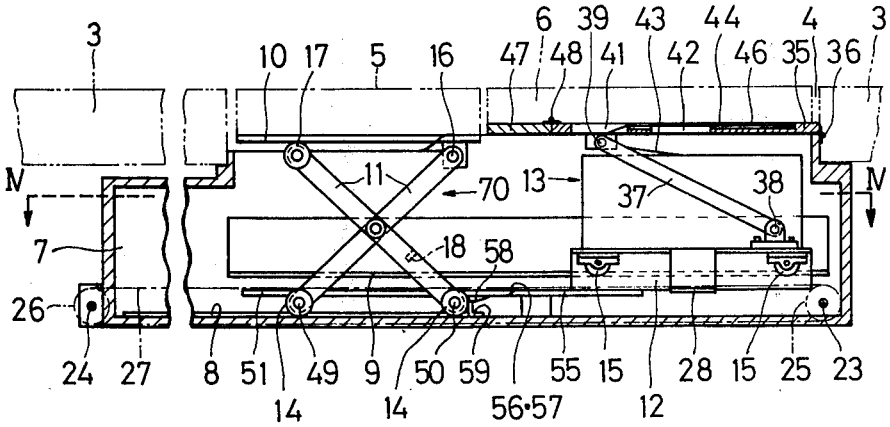
FIG. 2 is a vertical sectional side view of the excrement receptacle installed portion of the bed in the same state as FIG. 1.
Figure 3:
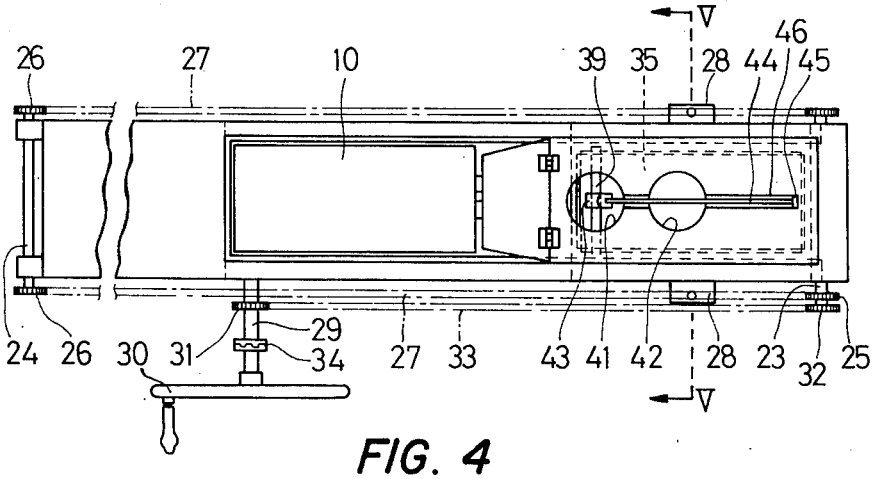
FIG. 3 is a top plan view thereof.
Figure 4:
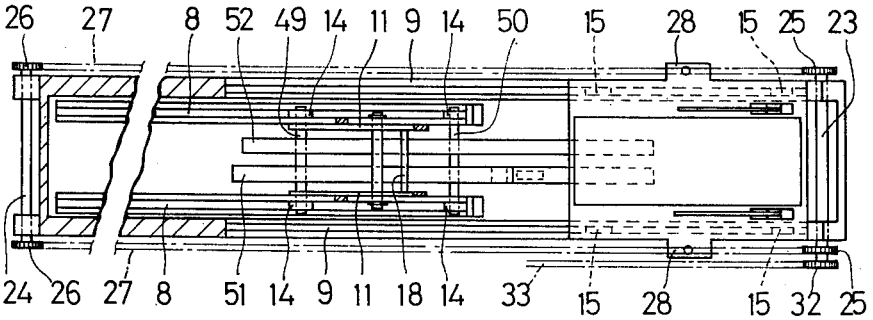
FIG. 4 is a plane sectional view taken along the line IV—IV of FIG. 2.
Figure 5:
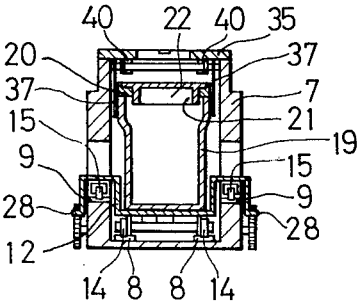
FIG. 5 is a longitudinal sectional view taken along the line V—V of FIG. 3.
Figure 6:
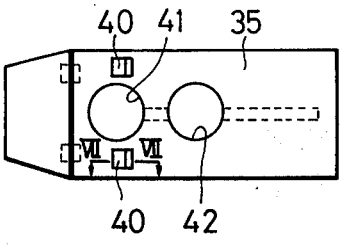
FIG. 6 is a bottom view of the second auxiliary mat support plate.
Figure 7:
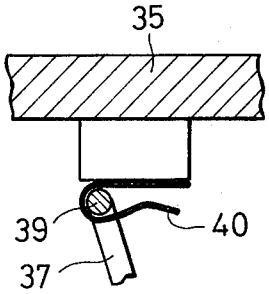
FIG. 7 is a sectional view taken along the line VII—VII of FIG. 6.

When the second auxiliary mat support plate 35 takes the perfectly retracted horizontal position as shown in FIG. 2, the leather band 43 assumes a perfectly lax state and the front covering 22 takes its position where it serves as cover of the excreta tank 19, while the second auxiliary mat 6 lies flush with the main mat 3 and perfectly closes the defecating hole 4 with the first auxiliary mat 5.

If a proper amount of deodorizing water is beforehand placed in the excreta tank 19, it needn't to throw away the excreta in the tank after every use. For taking out the excreta receptable 13 from the truck 12, first the pivot pins 39 at the upper ends of the bars 37 connecting the second auxiliary mat support plate and the truck 12, which is at the position shown in FIG. 2, as well as the leaf springs 40 are removed by inserting a hand from the hole 41 formed in said plate 35, then the leather band 43 secured to the front covering 22 is similarly removed by inserting a hand from another hole 42 to render said second auxiliary mat support plate 35 into a free state, and then, after completely opening up said plate 35, the excreta receptacle 13 is taken out. For again placing the excreta receptacle 13 in position on the truck 12, said receptacle is first inserted into its position on the truck 12, then the front covering 22 is caught by a hook at the end of the leather band 43 and then after fitting the pivot pins 39 in the respective leaf springs 40, the upper ends of the bars 37 are joined to the auxiliary mat support plate 35.

What is claimed is:

1. An invalid bed comprising a bed frame, a mat having formed centrally thereof a defecating hole, an auxiliary frame provided beneath said defecating hole, an excreta receptacle having a seat, a tank and a front covering mounted in said auxiliary frame, a truck on which said excreta receptacle is carried, a first and a second auxiliary mat arranged to normally close said defecating hole, a support plate for said first and second auxiliary mats, and means for supporting said first auxiliary mat support plate so as to be movable vertically, wherein said means for supporting said first auxiliary mat support plate is reciprocatable horizontally in said auxiliary frame and said excreta receptacle is also provided in said auxiliary frame and coupled integral to said means by connecting bars so that said truck is movable while tugging said means disposed adjacent thereto.

2. An invalid bed described in claim 1, wherein crossed expansion arms are used as said means for vertically movably supporting said first auxiliary mat support plate, and the wheels pivotally secured to the lower ends of said arms are supported on the rails laid in said auxiliary frame.

3. An invalid bed described in claim 1, wherein said first auxiliary mat is provided on its support plate at a position where it closes one of the forward portion of the defecating hole and the portion where the excreta receptacle is positioned in use, and said second auxiliary mat is provided on said support plate at a position where it closes the rearward portion of said defecating hole.

4. An invalid bed described in claim 1, wherein said excreta receptacle is provided with a front covering of which the maximum possible inclination can be adjusted in conformity to the body build of the invalid or user of the bed.

5. An invalid bed comprising a bed frame, a mat formed centrally thereof, a defecating hole, an auxiliary frame provided beneath the defecating hole, an excreta receptacle having a seat, a tank and a front covering mounted in said auxiliary frame, a truck on which said excreta receptacle is carried, a first and a second auxiliary mat arranged to normally close said defecating hole, a support plate for said first and second auxiliary mats, crossed expansion arms for supporting said first auxiliary mat support plate so as to be movable vertically, wheels pivotally secured to the lower ends of the crossed expansion arms and rails laid in the auxiliary frame supporting the wheels wherein said means for supporting said first axuiliary support plate is reciprocal horizontally in said auxiliary frame and said excreta receptacle is also provided in said auxiliary frame and coupled integrally to said means by connecting bars so that said truck is movable while tugging said means disposed adjacent thereto, a pair of wheel shafts for the crossed expansion arms of said first auxiliary mat support plate, connecting bars securedto the pair of wheel shafts, the connecting bar secured to the wheel shaft closer to the excreta receptacle truck being joined to said truck so as to be slidable slightly, the other of said connecting bars secured to the wheel shaft remote from said truck being provided with a cam piece connected to the wheel shaft and also formed at its end with a bevel opposed to and mating with a corresponding bevel formed at the opposing end of an auxiliary connecting bar secured to said truck, whereby said truck moves on its forward stroke, said both bevels contact and press against each other to push up said connecting bar to disengage the cam piece thereof from the associated wheel shaft, causing the wheel shaft remote from said truck to start moving to expand out said crossed expansion arms, and when the expansion arms have separated the greatest distance from each other to lower the first auxiliary mat support plate to its lowermost position, said means for supporting said first auxiliary mat support plate begins to move on its forward stroke.

6. An invalid bed comprising a bed frame, a mat having formed centrally thereof a defecating hole, an auxiliary frame provided beneath said defecating hole, an excreta receptacle having a seat, a tank and a front covering mounted in said auxiliary frame, a truck on which said excreta receptacle is carried, a first and a second auxiliary mat arranged to normally close said defecating hole, a support plate for said first and second auxiliary mats, and means for supporting said first auxiliary mat support plate so as to be movable vertically, wherein said means for supporting said first auxiliary mat support plate is reciprocable horizontally in said auxiliary frame and said excreta receptacle is also provided in said auxiliary frame and coupled integral to said means by connecting bars so that said truck is movable while tugging said means disposed adjacent thereto, wherein said first auxiliary mat is provided on its support plate at a position where it closes one of the forward portion of the defecating hole and the portion where the excreta receptacle is positioned in use, and said second auxiliary mat is provided on said support plate at a position where it closes the rearward portion of said defecating hole and wherein said second auxiliary mat support plate and said excreta receptacle truck are pivotally coupled by swingable bars such that said second auxiliary mat support plate will stay at its horizontal position when said truck is at its most advanced position or at its most retracted position, and said support plate will take the most turned up position when said truck is at the position intermediate said most advanced and most retracted positions.

7. An invalid bed comprising a bed frame, a mat having formed centrally thereof a defecating hole, an auxiliary frame provided beneath said defecating hole, an excreta receptacle having a seat, a tank and a front covering mounted in said auxiliary frame, a truck on which said excreta receptacle is carried, a first and a second auxiliary mat arranged to normally close said defecating hole, a support plate for said first and second auxiliary mats, and means for supporting said first auxiliary mat support plate so as to be movable vertically, wherein said means for supporting said first auxiliary mat support plate is reciprocable horizontally in said auxiliary frame and said excreta receptacle is also provided in said auxiliary frame and coupled integral to said means by connecting bars so that said truck is movable while tugging said means disposed adjacent thereto, wherein said excreta receptacle is provided with a front covering of which the maximum possible inclination can be adjusted in conformity to the body build of the invalid or user of the bed, which front covering of the excreta receptacle is connected to a suitable part of said second auxiliary mat support plate by a string-like member through the medium of an elastic body.

8. An invalid bed comprising a bed frame, a mat having formed centrally thereof a defecating hole, an auxiliary frame provided beneath said defecating hole, an excreta receptacle having a seat, a tank and a front covering mounted in said auxiliary frame, a truck on which said excreta receptacle is carried, a first and a second auxiliary mat arranged to normally close said defecating hole, a support plate for said first and second auxiliary mats, and means for supporting said first auxiliary mat support plate so as to be movable vertically, wherein said means for supporting said first auxiliary mat support plate is reciprocable horizontally in said auxiliary frame and said excreta receptacle is also provided in said auxiliary frame and coupled integral to said means by connecting bars so that said truck is movable while tugging said means disposed adjacent thereto, wherein said excreta receptacle is provided with a front covering of which the maximum possible inclination can be adjusted in conformity to the body build of the invalid or user of the bed, the main body of said front covering being formed from a plural number of blocks joined to each other bendable both forwardly and backwardly so that their outer peripheral edges alone can attach closely to the skin of the invalid's body portion from his crotch to the abdominal region, and an auxiliary block is joined to the free end side block to allow additional extension of said main body of the front covering.

* * * * *